US005703524A

United States Patent [19]

Chen

[11] Patent Number: 5,703,524

[45] Date of Patent: Dec. 30, 1997

[54] PIECE-WISE LINEAR APPROXIMATION OF A DB LINEAR PROGRAMMABLE GAIN AMPLIFIER

[75] Inventor: Xiaole Chen, Milpitas, Calif.

[73] Assignee: Exar Corporation, Fremont, Calif.

[21] Appl. No.: 631,900

[22] Filed: Apr. 16, 1996

[51] Int. Cl.[6] ..... G06G 7/12

[52] U.S. Cl. ..... 327/560; 327/346

[58] Field of Search ..... 327/346, 349, 327/306, 404, 560–563, 427; 326/83; 330/254

[56] References Cited

U.S. PATENT DOCUMENTS 4,360,786 11/1982 Rehfeldt ..... 330/254

5,045,804 9/1991 Sugawara et al. ..... 327/411

5,442,311 8/1995 Trafton ..... 327/346

5,463,349 10/1995 Petersen et al. ..... 330/254

5,619,169 4/1997 Matsuura ..... 330/254

*Primary Examiner*—Taon Tran

*Attorney, Agent, or Firm*—Townsend and Townsend and Crew LLP

[57] ABSTRACT

A programmable gain amplifier which can be realized using CMOS transistors. The amplifier provides a plurality of linear gain segments, with each of the gain segments having a different gain. A particular combination of the gain segments are selected using a digital control input to give an approximation of a linear dB output. By appropriately choosing the segments and how they combine, an approximation that is accurate to the least significant bit of a digital system can be provided.

15 Claims, 5 Drawing Sheets

| | Code | G | G(dB) | A(dB) | Δ(lsb) | Code | G | G(dB) | A(dB) | Δ(lsb) | |
|---|---|---|---|---|---|---|---|---|---|---|---|
| SEG. 1 | 0 | 1 | 0 | 0 | 0 | 32 | 1.41 | 2.984 | 3.01 | −0.276 | SEG. 3 |
| | 1 | 1.011 | 0.097 | 0.094 | 0.033 | 33 | 1.427 | 3.088 | 3.104 | −0.177 | |
| | 2 | 1.023 | 0.193 | 0.188 | 0.054 | 34 | 1.444 | 3.19 | 3.198 | −0.091 | |
| | 3 | 1.034 | 0.288 | 0.282 | 0.065 | 35 | 1.461 | 3.291 | 3.293 | −0.019 | |
| | 4 | 1.045 | 0.382 | 0.376 | 0.064 | 36 | 1.478 | 3.391 | 3.387 | 0.042 | |
| | 5 | 1.056 | 0.475 | 0.47 | 0.053 | 37 | 1.494 | 3.489 | 3.481 | 0.091 | |
| | 6 | 1.068 | 0.567 | 0.564 | 0.031 | 38 | 1.511 | 3.587 | 3.575 | 0.128 | |
| | 7 | 1.079 | 0.658 | 0.659 | −0.001 | 39 | 1.528 | 3.683 | 3.669 | 0.153 | |
| | 8 | 1.09 | 0.749 | 0.753 | −0.043 | 40 | 1.545 | 3.779 | 3.763 | 0.167 | |
| | 9 | 1.101 | 0.838 | 0.847 | −0.095 | 41 | 1.562 | 3.873 | 3.857 | 0.17 | |
| | 10 | 1.113 | 0.926 | 0.941 | −0.156 | 42 | 1.579 | 3.966 | 3.951 | 0.162 | |
| | 11 | 1.124 | 1.013 | 1.035 | −0.227 | 43 | 1.596 | 4.059 | 4.045 | 0.144 | |
| | 12 | 1.135 | 1.1 | 1.129 | −0.308 | 44 | 1.613 | 4.15 | 4.139 | 0.115 | |
| | 13 | 1.146 | 1.186 | 1.223 | −0.397 | 45 | 1.629 | 4.24 | 4.233 | 0.076 | |
| | 14 | 1.158 | 1.27 | 1.317 | −0.495 | 46 | 1.646 | 4.33 | 4.327 | 0.028 | |
| | 15 | 1.169 | 1.354 | 1.411 | −0.602 | 47 | 1.663 | 4.418 | 4.421 | −0.031 | |
| SEG. 2 | 16 | 1.18 | 1.438 | 1.505 | −0.718 | 48 | 1.68 | 4.506 | 4.515 | −0.098 | SEG. 4 |
| | 17 | 1.194 | 1.543 | 1.599 | −0.6 | 49 | 1.7 | 4.609 | 4.61 | −0.006 | |
| | 18 | 1.209 | 1.647 | 1.693 | −0.495 | 50 | 1.72 | 4.711 | 4.704 | 0.074 | |
| | 19 | 1.223 | 1.749 | 1.787 | −0.403 | 51 | 1.74 | 4.811 | 4.798 | 0.142 | |
| | 20 | 1.238 | 1.851 | 1.881 | −0.325 | 52 | 1.76 | 4.91 | 4.892 | 0.197 | |
| | 21 | 1.252 | 1.951 | 1.976 | −0.258 | 53 | 1.78 | 5.008 | 4.986 | 0.24 | |
| | 22 | 1.266 | 2.05 | 2.07 | −0.204 | 54 | 1.8 | 5.105 | 5.08 | 0.272 | |
| | 23 | 1.281 | 2.148 | 2.164 | −0.162 | 55 | 1.82 | 5.201 | 5.174 | 0.292 | |
| | 24 | 1.295 | 2.245 | 2.258 | −0.131 | 56 | 1.84 | 5.296 | 5.268 | 0.301 | |
| | 25 | 1.309 | 2.341 | 2.352 | −0.112 | 57 | 1.86 | 5.39 | 5.362 | 0.299 | |
| | 26 | 1.324 | 2.436 | 2.446 | −0.104 | 58 | 1.88 | 5.483 | 5.456 | 0.287 | |
| | 27 | 1.338 | 2.53 | 2.54 | −0.106 | 59 | 1.9 | 5.575 | 5.55 | 0.264 | |
| | 28 | 1.353 | 2.623 | 2.634 | −0.12 | 60 | 1.92 | 5.666 | 5.644 | 0.231 | |
| | 29 | 1.367 | 2.715 | 2.728 | −0.144 | 61 | 1.94 | 5.756 | 5.738 | 0.188 | |
| | 30 | 1.381 | 2.805 | 2.822 | −0.178 | 62 | 1.96 | 5.845 | 5.832 | 0.135 | |
| | 31 | 1.396 | 2.895 | 2.916 | −0.222 | 63 | 1.98 | 5.933 | 5.927 | 0.072 | |

FIG. 3

| Segment | k | ΔG(k) |
|---|---|---|
| 1 | 0 | 0.18 |
| 2 | 16 | 0.23 |
| 3 | 32 | 0.27 |
| 4 | 48 | 0.32 |
FIG. 4
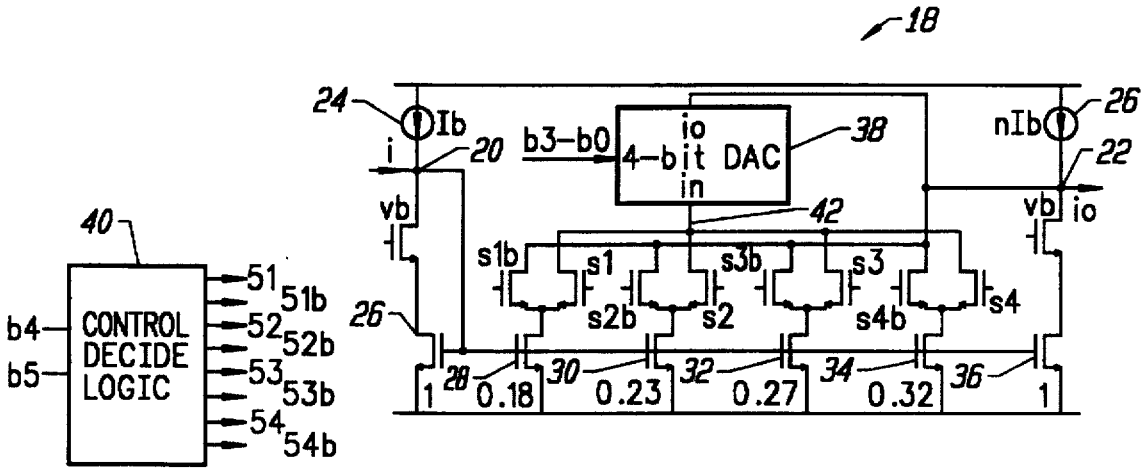
FIG. 5
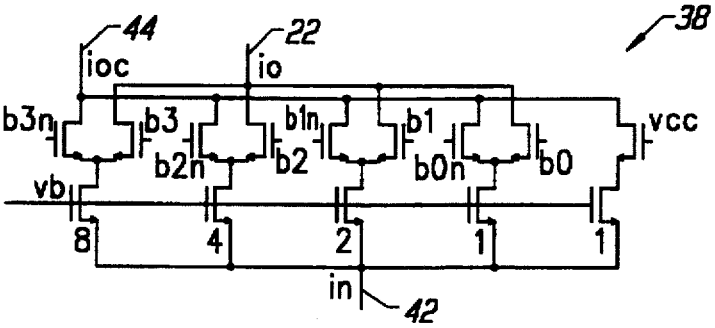
FIG. 6

| b5b4 | s1 | s1b | s2 | s2b | s3 | s3b | s4 | s4b |
|---|---|---|---|---|---|---|---|---|
| 00 | 1 | 0 | 0 | 0 | 0 | 0 | 0 | 0 |
| 01 | 0 | 1 | 1 | 0 | 0 | 0 | 0 | 0 |
| 10 | 0 | 1 | 0 | 1 | 1 | 0 | 0 | 0 |
| 11 | 0 | 1 | 0 | 1 | 0 | 1 | 1 | 0 |
FIG. 7
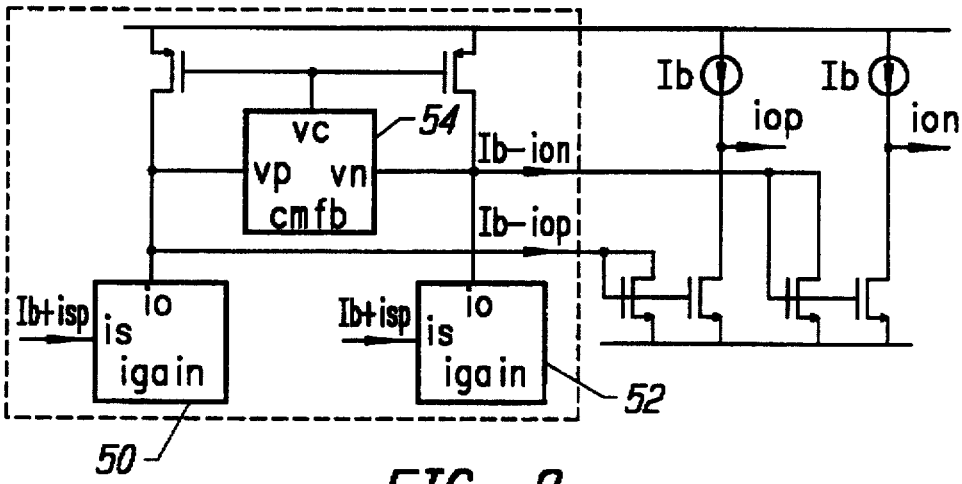
FIG. 8
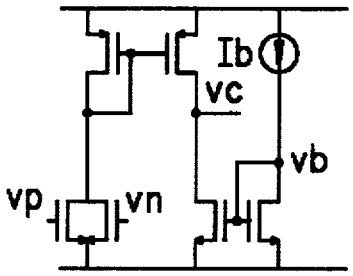
FIG. 9

PIECE-WISE LINEAR APPROXIMATION OF A DB LINEAR PROGRAMMABLE GAIN AMPLIFIER

BACKGROUND OF THE INVENTION

The present invention relates to programmable gain amplifiers, in particular amplifiers which provide a dB linear output.

A typical implementation of a programmable gain amplifier (PGA) which provides a dB linear output is accomplished using bipolar transistors. This is because the desired exponential function is an intrinsic characteristic of a bipolar transistor. Oftentimes, such a circuit needs to be used in conjunction with digital circuits implemented in CMOS technology. This may require a separate semiconductor chip used for the bipolar PGA, or the use of a chip having a combination of bipolar and CMOS, or biCMOS technology. Since pure CMOS technology is cheaper and requires less power, it would be desirable to have an implementation of a dB linear PGA in CMOS technology.

SUMMARY OF THE INVENTION

The present invention provides a programmable gain amplifier which can be realized using CMOS transistors. The amplifier provides a plurality of linear gain segments, with each of the gain segments having a different gain. A particular combination of the gain segments are selected using a digital control input to give an approximation of a linear dB output. By appropriately choosing the segments and how they combine, an approximation that is accurate to the least significant bit of a digital system can be provided.

In a preferred embodiment, the invention recognizes that the length of the segments which approximate the exponential curve can be longer for higher gain segments. This is because the exponential curve exhibits more linear characteristics at the higher gain stages. The invention is preferably implemented using a plurality, such as four, of CMOS transistors, each having different size characteristics to provide different gain values. A constant current source at the output is then directed through the appropriate gain transistor. The most significant bits of a control signal select a particular gain transistor, while the least significant bits select a fractional component which is directed through another of the gain transistors. The fractional component corresponds to the individual linear segments, with the fractional components being directed towards the higher gain transistors as the desired gain moves up in value, thus giving larger segments.

In one embodiment, the fractional component is generated by a digital-to-analog converter (DAC) which has four pairs of transistors for switching in the different components of the digital-to-analog converter. The transistors are arranged in pairs, with either the current being provided by the constant current output, or a complementary current source, so that the total current provided through the DAC will be constant, while the fractional component of the current from the output will vary.

For a fuller understanding of the nature and advantages of the invention, reference should be made to the following description taken in conjunction with the accompanying drawings.

BRIEF DESCRIPTION OF THE DRAWINGS

FIG. 3 is a table of the control code values versus the gain produced by one embodiment of the present invention;

FIG. 4 is a table of the segments and a corresponding gain code and gain increment of each segment;

FIG. 5 is a diagram of the preferred embodiment of one stage of the programmable gain amplifier according to the present invention;

FIG. 6 is a diagram of the DAC of FIG. 5;

FIG. 7 is a table of the control codes for the embodiment of FIG. 5;

FIG. 8 is a diagram of a differential version of the programmable gain amplifier of FIG. 5;

FIG. 9 is a diagram of the common mode feedback block of FIG. 8;

DESCRIPTION OF THE PREFERRED EMBODIMENT

Figure 1:
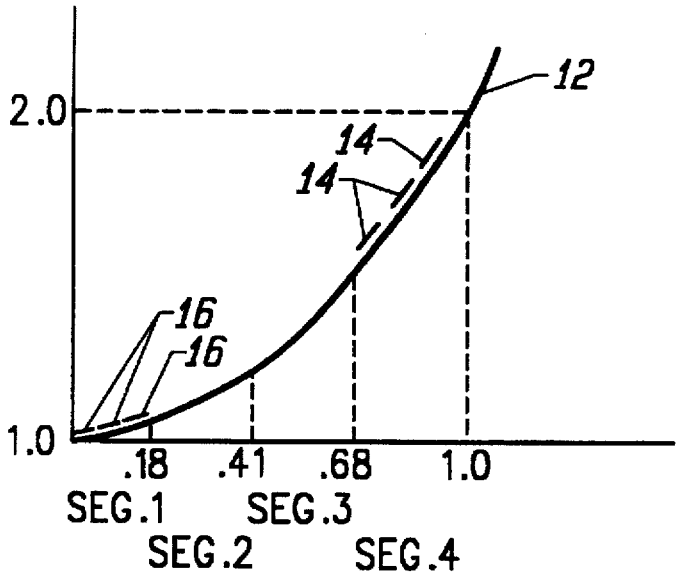
FIG. 1 is a diagram of an exponential curve illustrating the segments used by the present invention.

FIG. 1 is a diagram of an exponential curve 12 broken up into four segments, labeled SEG.1–SEG.4. On a scale of zero to 1.0, the segments break at 0.18, 0.41 and 0.68. The size of the segments increases as the gain on curve 12 increases. It can be seen that the exponential curve can be approximated by a series of linear segments. For instance, illustrative linear segments 14 in SEG. 4 can approximate the curve 12 in this region. Similarly, illustrative segments 16 in SEG. 1 can approximate the exponential curve 12 in that region (an enlarged scale is used for illustration, more than 3 segments would be used). Note that segment 16 needs to be smaller to provide the same margin of error since the curve is changing more rapidly in SEG. 1. In SEG. 4, the curve is straighter, enabling it to be approximated by larger linear segments. As can be seen, the four segments of FIG. 1 approximate an exponential curve going from a gain of 1 to 2.0.

Figure 2:
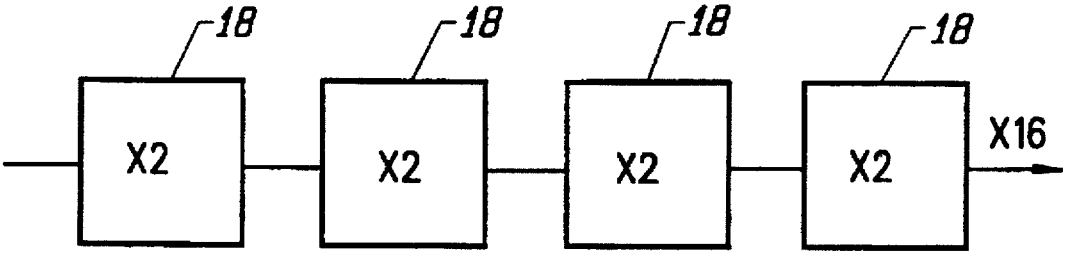
FIG. 2 is a block diagram of a programmable gain amplifier with multiple stages according to one embodiment of the present invention.

FIG. 2 illustrates how four gain stages 18, each having a multiplication factor of 2, can be combined in series to provide an overall gain of a factor of 16. In a preferred embodiment of the invention, each of the gain stages is broken up to provide the four segment approximation shown in FIG. 1. It should be appreciated, however, that different numbers of gains stages or different numbers of segments in the gains stages could be used, as well as differing numbers of linear segments within each segment.

FIG. 3 is a table illustrating the use of a 6-bit digital control code, giving values 0–63 for selecting an appropriate gain. The codes select within one of the four segments as illustrated. Next to each code value is shown the gain provided, GE. Next, the linear dB gain, G(dB), is shown. Finally, the actual ideal linear gain, A(dB) is shown. Next, the variation from the gain provided by the present invention from the ideal, actual gain, is shown as a fraction of the least significant bit (LSB).

The invention uses a piece-wise-linear (PWL) function to approximate the desired dB linear function. The exponential gain control function, which is dB linear, is divided into several non-identical segments. In each segment, the gain is changed linearly. If the segments are small enough, the differential non-linearity of the PWL approximation will be less than 1 LSB. For example, to implement a dB linear PGA with gain between 1 and A, n major gain segments can be designed as $1-A^{1/n}$, $A^{1/n}-A^{2/n}$, . . . $A^{n-1/n}-A$. In each segment, a linear division is used to increase the number of the gain control bits. A numerical example, which has a maximum gain of two, and four major gain control segments, is calculated. FIG. 3 lists the calculated magnitude and dB gain of the PWL approximation (G and G(dB)), the exact gain value (A(dB)), and the integral gain error in terms of LSB (Δ(lsb)) at different gain control codes. The magnitude of the gain of the PWL approximation is calculated according to the following equation.

$$G(n)=G(k)+\Delta G(k)\cdot(n-k)/16.(n>k)$$

Where n, k, and ΔG(k) represent the code of the gain, the gain code of the beginning of each segment, and the gain increment of the segment. The gain of the example PGA is controlled by six digital control bits (64 gain settings). The values of the k and ΔG(k) of the example of FIG. 3 are shown in the table of FIG. 4. The maximum gain error (−0.718 lsb) occurs at code 16. The gain error can be reduced by choosing the segmentation values closer to the ideal values. However, the exact values are harder to implement in hardware because of the device parameter variations at different IC processes.

FIG. 5 is a circuit implementation of one embodiment of the present invention implementing the coding of FIG. 3. FIG. 5 shows a programmable gain stage 18 of FIG. 2. An input current I is shown in a node 20, while an output current I0 is shown at a node 22. Input current source 24 is provided to provide a constant current at the input, while output current source 26 provides a constant current source to the output node 22. The input current provides a current mirror relationship between transistor 26 and gain transistors 28, 30, 32 and 34, as well as an output transistor 36. Transistors 26 and 36 have their width and length (W/L) chosen to provide a size which gives a current value of 1, compared to a value of 0.18 for transistor 28, 0.23 for transistor 30, 0.27 for transistor 32 and 0.32 for transistor 34. These gain values correspond to the four segments illustrated in FIG. 1. As can be seen, one of a plurality of switches s1*b*, s2*b*, s3*b* or s4*b* will direct the output current at node 22 through one of the gain transistors 28–34. By selecting the appropriate gain transistor, the segment can be chosen. The NMOS transistors controlled by the switching control signals are switching devices with a small voltage drop between their drain and source. The fractional component of each segment is provided by a digital-to-analog converter (DAC) 38. This provides the fractional value within one of the four segments, as indicated by the linear approximations 14 and 16 of FIG. 1, for instance. A number of switches s1, s2, s3 and s4 select which gain transistor the fractional part is provided through.

As noted above with respect to FIG. 1, the higher the gain value, the larger the linear segment that can be used to approximate the exponential curve. Accordingly, for higher gain components, the larger segments in SEG. 4 shown in FIG. 1 would be selected by directing the fractional component from DAC 38 through transistor 34 using switch s4. Alternately, segment 16 of FIG. 1 would be selected where there is only a fractional value and none of the segments have been exceeded, by selecting transistor 28 using switch s1. The segments are selected using a control decode logic block 40 which takes the two most significant bits of the 6-bit control input b4 and b5, and produces the signals s1, s1*b*–s4, s4*b*. A particular value is used depending on the input control codes as shown in FIG. 7. For example, for the code 00, none of the gain transistors are selected, and instead switch s1 is selected to provide the fractional component through the first gain transistor 28, providing a fraction of the 0.18 value. This fractional part is selected by bits b0–b3, input to DAC 38, selecting one of the gain values illustrated in FIG. 3 for codes 0–15. In an alternate example, the value 11 selects transistor 28 (0.18 gain) transistor 30 (0.23 gain) and transistor 32 (0.27 gain). This gives a total gain of 0.68, illustrating the beginning of SEG.4 shown in FIG. 1. The fractional component from DAC 38 is then selected with 1-bit for s4, as shown in the table of FIG. 7.

FIG. 6 is a diagram of one embodiment of the DAC 38 of FIG. 5. As can be seen, the output current node 22 is connected at the top, while the input node 42 provided to the various switches is shown at the bottom. The cascoded transistors shown with attenuation values of 1, 2, 4 and 8 can be combined to provide an attenuation from 1/16 to 15/16. The particular ones that are combined are determined by a series of transistors switched with control signals b0, b0n–b3, b3n. The b0–b3 values are selected by the least significant four bits of control code. The inverse of these values are provided to switches b0n–b3n. These select a current source connected to node 44 (which is complementary to current source connected to node 22) such that any portion not selected to be connected to node 22 of the output current is selected to be connected to the complementary current source 44. This ensures that the total current provided to the input node 42 is always the same, while allowing a variation of the fractional component connected to node 22.

In a preferred embodiment, gain transistors 28–34 are NMOS transistors. The scaling transistors of the 4-bit DAC 38 are used as a cascade device. The bias current from current source 26 is set according to the gain of the particular stage.

FIG. 8 illustrates an embodiment where a differential input current signal is used. Here, the single-ended PGA can be modified to provide two complementary gain stages 50 and 52 corresponding to the circuit 18 of FIG. 5. A common mode feedback block 54 is provided to automatically adjust the bias current nIb supplied to the output node of the current gain block 56. The current gain blocks 50 and 52 are similar to the circuit illustrated in FIG. 5, except that there are no bias currents Ib and nIb.

FIG. 9 illustrates one embodiment of the common mode feedback block 54 of FIG. 8.

Figure 10:
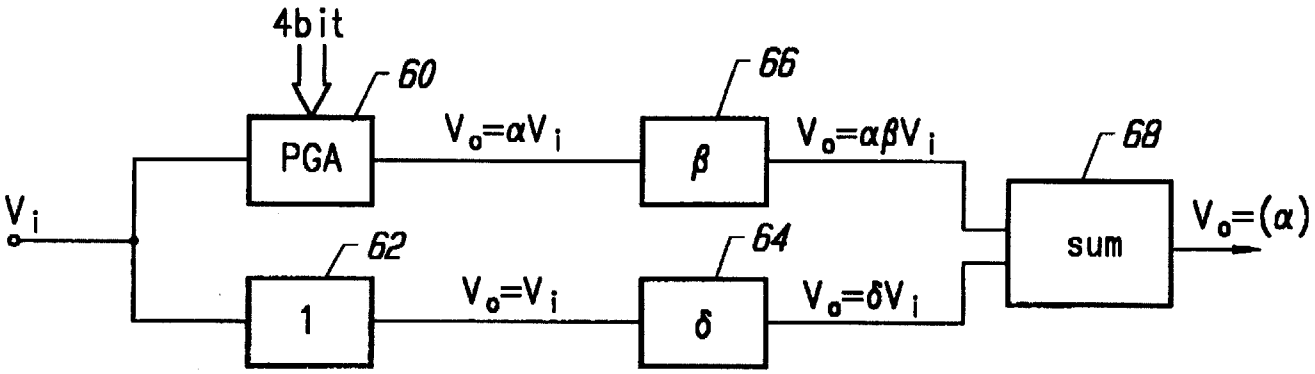
FIG. 10 is a block diagram of an alternate embodiment of the invention using switched capacitor technology.

The present invention may also be embodied in other technologies to realize the differential-sized gain segments of the present invention. For example, a block diagram of a switched capacitor embodiment is illustrated in FIG. 10. As shown in FIG. 10, the input signal is multiplied by unity value illustrated by block 62, and combined with a fractional component, illustrated by block 60. Both of these can then be multiplied by different gain values in blocks 64 and 66, respectively. The two values are then summed in a summing circuit 60 to provide the final gain output. In one embodiment, block 66 can multiply by 0.18, 0.23, 0.27 or 0.32. Block 64 can multiply by 1, 1.18, 1.41 or 1.68.

Figure 11:
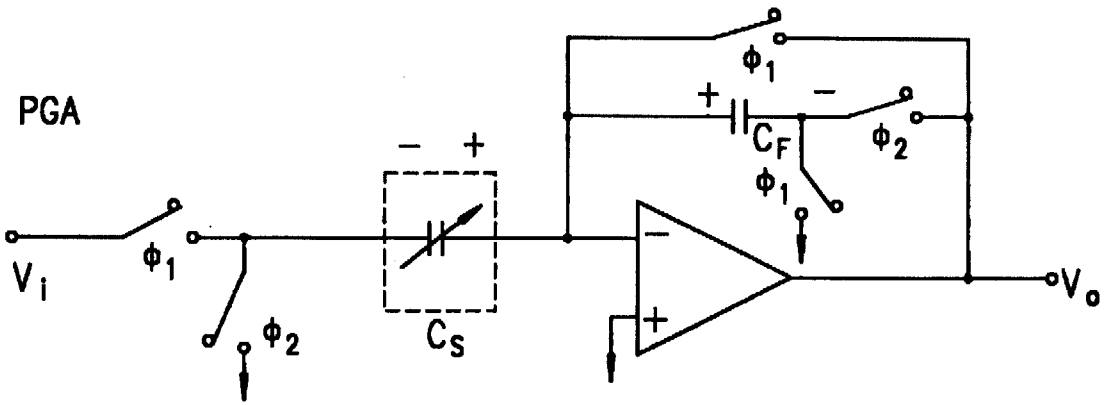
FIG. 11 is a diagram of one embodiment of the blocks of FIG. 10.

FIG. 11 illustrates one embodiment of any of blocks 60, 62, 64 and 66 of FIG. 10.

As will be understood by those of skill in the art, the present invention may be embodied in other specific forms without departing from the spirit or essential characteristics thereof. For example, different gain values could be selected to provide a closer approximation to the exponential curve where more accuracy is needed. In addition, additional gain stages could be added and a larger number of segments could be used. Accordingly, the foregoing embodiment is intended to be illustrative, but not limiting, of the scope of the invention which is set forth in the following claims.

What is claimed is:

1. A programmable gain amplifier comprising:

a plurality of linear gain segments, each of said linear gain segments having a different gain;

a multiple bit digital control input; and selection logic, coupled to said multiple bit digital control input, configured to selectively enable desired ones of said linear gain segments.

2. The amplifier of claim 1 wherein said selection logic comprises:

first selection logic configured to select one of said linear gain segments; and second selection logic configured to select a fraction to be applied to one of said gain segments.

3. The amplifier of claim 2 wherein said second selection logic is coupled to larger linear gain segments for larger desired gain values.

4. The amplifier of claim 2 wherein said second selection logic comprises an analog to digital converter.

5. The amplifier of claim 1 further comprising a second plurality of linear gain segments arranged to provide a differential gain output.

6. The amplifier of claim 1 wherein said amplifier comprises one stage of a multi-stage amplifier.

7. The amplifier of claim 1 wherein said gain segments comprise a plurality of CMOS transistors having different sizes.

8. The amplifier of claim 7 further comprising:

a current source;

first selection logic connected to direct current from said current source through a selected combination of said CMOS transistors; and second selection logic connected to direct a selected fraction of current from said current source through one of said CMOS transistors not in said combination.

9. The amplifier of claim 8 wherein said second selection logic is always coupled to a CMOS transistor having a larger size than the CMOS transistors in said combination.

10. A programmable gain amplifier comprising:

a constant current source;

a plurality of CMOS gain transistors of different sizes;

a first plurality of switching transistors connected between said constant current source and said CMOS gain transistors;

a fractional current generating circuit coupled to said constant current source; and a second plurality of switching transistors connected between said fractional current generating circuit and said plurality of CMOS gain transistors.

11. The amplifier of claim 10 further comprising a digital control input having least significant bits coupled to said fractional current generating circuit and most significant bits coupled to said first and second plurality of switching transistors.

12. The amplifier of claim 11 further comprising decoding logic coupled between said most significant bits of said digital control input and said switching transistors.

13. The amplifier of claim 12 wherein said decoding logic always controls said second plurality of switching transistors to couple said fractional current generating circuit to a CMOS gain transistor having a larger size than any transistor in a combination of said CMOS gain transistors selected by said first plurality of switching transistors.

14. The amplifier of claim 10 wherein said fractional current generating circuit comprises a digital to analog converter.

15. The amplifier of claim 10 wherein said fractional current generating circuit is connected to a second current source, and supplies a constant current to said CMOS gain transistors, while varying the fraction of said constant current from said first current source.

* * * * *